United States Patent [19]

Lindstrom

[11] 4,134,690

[45] Jan. 16, 1979

[54] MIXER BLADE FOR A MIXER TANK

[75] Inventor: Harold R. Lindstrom, Des Moines, Iowa

[73] Assignee: Deere & Company, Moline, Ill.

[21] Appl. No.: 893,854

[22] Filed: Apr. 6, 1978

[51] Int. Cl.[2] ..... B01F 15/02

[52] U.S. Cl. ..... 366/266

[58] Field of Search ..... 366/266, 241, 318, 319, 366/341, 349, 248, 280, 309, 311, 314

[56] References Cited

U.S. PATENT DOCUMENTS

| | | | |
|---|---|---|---|
| 1,519,664 | 12/1924 | Campbell | 366/266 |
| 3,487,961 | 1/1970 | Neuenschwander | 366/266 |
| 3,667,734 | 6/1972 | Skromme | 366/266 |
| 3,997,146 | 12/1976 | Kline | 366/266 |

*Primary Examiner*—Edward J. McCarthy

[57] ABSTRACT

An improved mixing blade assembly is disclosed that reduces torque requirements and impact loading in a mixer. The assembly is particularly useful in conjunction with a mixer-grinder having an upright cylindrical tank with a substantially flat bottom and centrally located vertical mixing auger. The assembly includes a blade mounted on the auger for rotation therewith. The blade is generally parallel to and spaced above the floor and terminates inwardly from the tank wall so coarse material can slide off its end. The floor-to-blade spacing eliminates shear forces and impact loads that would otherwise occur as the blade sweeps over openings in the tank bottom. An extension member is pivotally connected to the blade about a vertical axis and is freely swingable between the blade and the floor. The extension member extends radially outwardly by centrifugal force to sweep close to the floor near the tank wall as the tank empties. When the tank is full, the member trails behind the blade to avoid packed material near the outside of the tank.

15 Claims, 4 Drawing Figures

MIXER BLADE FOR A MIXER TANK

BACKGROUND OF THE INVENTION

The present invention relates generally to an agricultural grinding and mixing implement and more particularly to a mixing blade used with a cylindrical, flat bottomed mixer tank.

In order to provide an improved mixer-guide having a lower center of gravity and greater volume, and avoid bridging of material during the mixing process, an upright cylindrical tank having a substantially flat bottom has been utilized in place of the conventional tanks with a conical bottom. Such a flat-bottomed mixing apparatus is illustrated in U.S. Pat. No. 3,667,734 to Skromme et al., issued June 6, 1972, and includes a center mixing auger operable within a vertical housing mounted concentrically within the tank. That design utilizes a mixing blade which is fixed to the bottom of the auger and sweeps the tank bottom as the auger rotates. The mixing blade, in conjunction with the mixing auger, agitates and thoroughly mixes the materials in the tank. Grinder-mixers with that tank design are capable of circulating and mixing roughage material that might otherwise cause bridging in the throat of a conventional tank with a conical bottom.

The mixing blade commonly used with a flat-bottomed tank is attached to the auger with only a fraction of an inch clearance provided between the tank floor and the bottom blade surface. The blade extends outwardly to within a fraction of an inch of the inside surface of the vertical walls of the tank, and a circumferential guide is provided near the outer end of the blade to constrain it near to the floor. The blade sweeps across two openings in the tank bottom, one for loading and one for unloading. Even though the leading edge of the blade is beveled to a sharp edge, coarsely ground material such as hay can be trapped between the edges of the openings and the blade and cause excessive impact loads as the blade sweeps over the openings. This type of load is especially severe across the discharge hole located near the vertical wall of the tank, since the material tends to be more concentrated and packed near the end of the blade. The load caused by the outer tip of the blade passing through the concentrated and packed material greatly increases the torque requirements. Also, roughage material cannot slide off the free end of the blade because of the small amount of clearance between the blade end and the tank wall thus adding to the load. These added loads can eventually damage the blade, mixing auger and drive train parts.

SUMMARY OF THE INVENTION

It is, accordingly, the primary object of the present invention to provide a mixing blade which presents none of the abovementioned problems.

More particularly, it is an object to provide a blade which greatly reduces loading and torque requirements and yet provides for thorough mixing and tank emptying.

It is a further object to provide a mixing blade that need not be confined under a guide and yet includes a portion that sweeps adjacent to but not in contact with the floor.

It is still another object to provide a blade with an increased floor-to-blade distance as well as an increased blade-to-wall distance to reduce shear effect, to eliminate need for the blade to pass through material packed near the walls of the tank while the tank is full, and to allow roughage to slide out and off of the free end of the blade.

It is a further object to provide a blade with an extension mounted thereon that swings outwardly toward the wall of the tank during emptying to clean out material beyond the reach of the blade and which trails behind the blade when the tank is full or partially full to reduce torque requirements. The extension is located closer to the floor than the blade to effectively sweep the tank. The blade is fixed to and extends generally horizontally from the vertical auger. The extension is mounted on the blade for swinging about a vertical axis and has an essentially flat bottom which is maintained adjacent to but out of contact with the floor.

BRIEF DESCRIPTION OF THE DRAWINGS

The preferred embodiment of the present invention will be described in conjunction with the accompanying drawings in which.

DESCRIPTION OF THE PREFERRED EMBODIMENT

Figure 2:
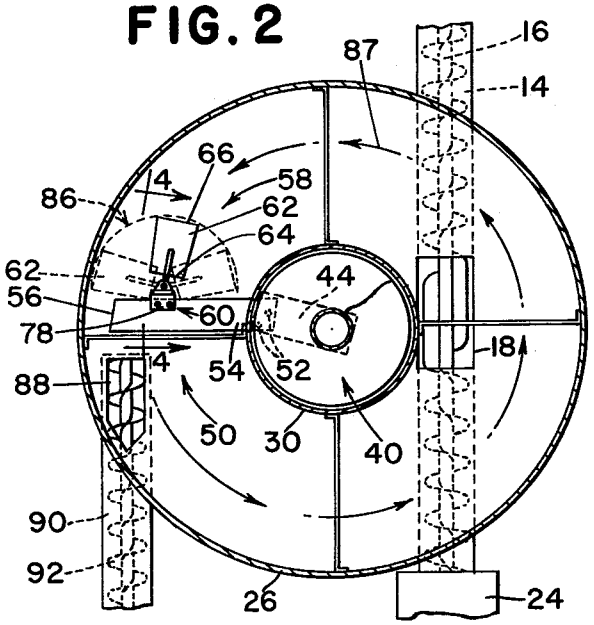
FIG. 2 is a vertical sectional view taken along the line 2—2 of FIG. 1 with the mixing blade rotated 270° from the position shown in FIG. 1.
Figure 3:
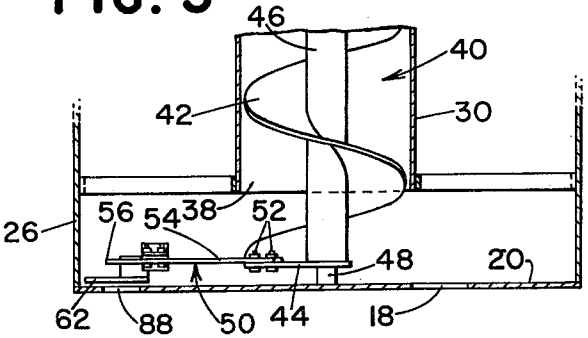
FIG. 3 is a fragmentary side view of the lower portion of the tank showing the extension member in the cleanout position.

The device incorporating the present form of the invention is shown as a portable feed grinding and mixing machine 10 of the type disclosed in the aforementioned Skromme patent and includes a hammer mill 12 for grinding material such as hay. After being ground and reduced in size, the material is collected in auger trough 14 and conveyed by auger 16 rearwardly to inlet opening 18 in the bottom 20 of tank 22. Additional ingredients can be introduced into the mixing tank 22 through inlet 18 by placing them in concentrate hopper 24. The rear section of auger 16 has flighting wound oppositely from that of the forward end to convey material in hopper 24 to inlet 18. The auger is driven in a conventional manner from the drive shaft of a tractor or the like.

Tank 22 includes a cylindrical wall 26 extending upwardly from the bottom 20 and enclosed at the opposite end by top 28. A vertical tubular housing 30 is supported concentrically within the tank 22 by horizontal straps 32 and upright straps 34. The auger housing 30 terminates short of the top and bottom of tank 22 to provide upper and lower openings 36 and 38, respectively. Vertical mixing auger 40 is rotatably mounted within housing 30 to receive material through opening 38 and advance it upwardly through housing 30 and out opening 36. The spiral flighting 42 of auger 40 terminates at its lower end on bar 44 mounted on auger core tube or shaft 46. The core tube 46 and bar 44 are spaced above floor 20 on a shaft 48. The vertical auger assembly is driven in a conventional manner from the power takeoff shaft on the tractor through a bevel gear arrangement (not shown) in gear case 49.

Bolted or otherwise connected to the bar 44 is sweep or mixing blade assembly 50. As shown in FIG. 2, two bolts 52 attach a blade or arm 54 to the bar 44 so that the leading edge of the blade intersects the leading edge of bar 44 at an angle slightly less than 180°. Outer end 56 of blade 54 is spaced inwardly from the inside of tank wall 26 preferably about 6 inches. Blade 54 is substantially flat with parallel leading and trailing edges and angled ends. The blade is mounted on the auger assembly generally parallel to the tank bottom 20. The lower side of blade 54 is spaced from the tank bottom 20, preferably about 1.2 inches, in order that shear forces be reduced, as discussed in detail below.

Figure 4:
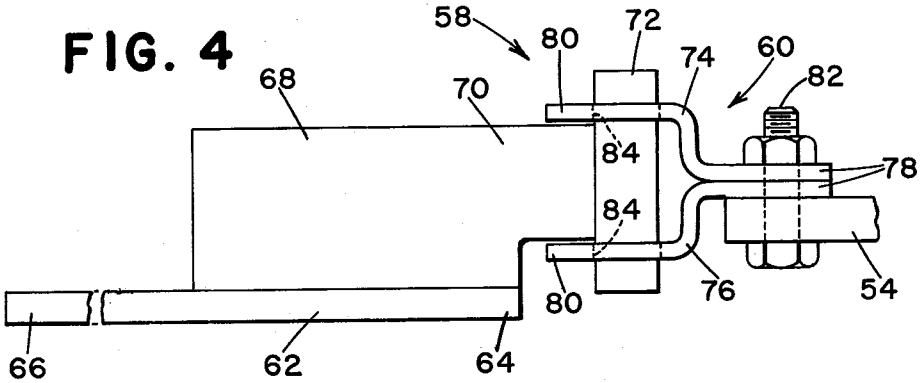
FIG. 4 is an enlarged side view of the extension member and the mounting bracket.
Figure 1:
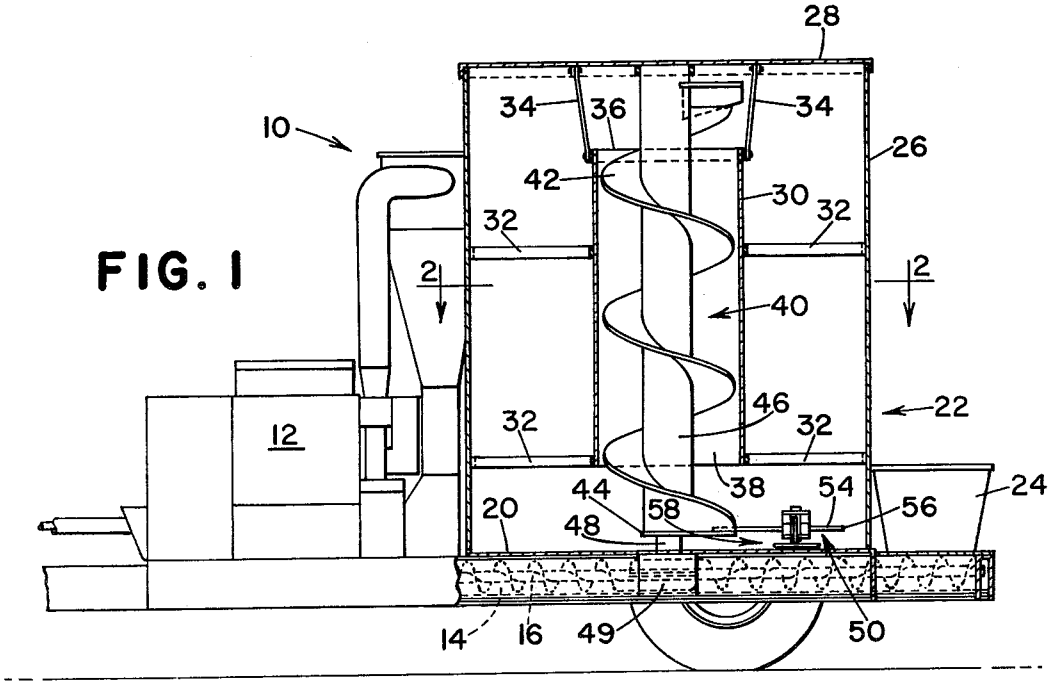
FIG. 1 is a sectional side view of the grinder-mixer incorporating the device of the present invention.

Assembly 50 also includes a free swinging cleanout blade or extension assembly 58 mounted on the trailing edge of the blade 54 by a two-piece bracket 60. A metal cleanout blade or paddle 62, having essentially a flat lower side positioned parallel to the tank bottom tapers slightly outwardly from front portion 64 to rear portion 66. As shown best in FIG. 4, there is welded perpendicularly to cleanout blade 62 near the front edge 64 a connecting brace 68 having a forward extension 70. A pivot pin 72 is welded to extension 70 so that the axis of the pin is essentially perpendicular to the bottom surface of blade 62. It can be seen that the center of gravity of the paddle assembly 58 is located substantially rearwardly of pivot 72 so that the whole assembly as it rotates is urged radially outwardly toward the wall 26 by centrifugal force. Bracket 60 includes identical halves 74, 76 each having a widened section 78 with two bolt receiving holes and a narrowed upstanding section 80 with a pivot receiving hole 84. The identical halves 74, 76 are assembled on the top side of the blade 54 using two bolts 82 which pass through holes in widened sections 78 and corresponding holes in the trailing edge of blade 54. Pivot pin 72 of blade assembly 58 is inserted into holes 84 of halves 74, 76 before final tightening of bolts 82. When fully assembled, bracket 60 secures the paddle assembly 58 to the rear of the blade 54. The vertical dimension of extension 70 is slightly less than the spacing between ends 80 of assembled halves 74, 76 to allow blade assembly 58 to pivot freely in the bracket about a substantially vertical axis while preventing any substantial vertical deflection of blade 62. Blade 62 is thus supported essentially parallel to, and slightly above floor 20. Since pivot 72 is positioned rearwardly from blade 54 by bracket 60, the extension assembly 58 can swing from the trailing position as shown by the solid lines in FIG. 2 to a side sweep position as indicated by the leftmost broken lines. The blade 62 can also pivot in the opposite direction towards auger 40 as shown by the rightmost broken lines. When the blade assembly 50 is operating under a load, as for example occurs when the mixing tank is full, blade 62 trails blade 54 as shown by the solid lines in FIG. 2. Under reduced load conditions, especially when the tank is nearly empty, centrifugal force swings the blade outwardly to the position shown by the leftmost broken lines so that rear portion 66 extends preferably to within a fraction of an inch of the inside of sidewall 26. The swinging of blade 62 toward the wall takes place gradually as the tank empties and the load correspondingly decreases. Blade 62 can swing about its pivot 72 in either direction from the position shown by the solid lines in FIG. 2 since movement is only limited by the brace 68 contacting blade 54. The rear portion 66 essentially traverses an arc indicated by line 86 that passes within a fraction of an inch of sidewall 26. From the foregoing, it can be seen that the effective length of the blade 62 is approximately equal to but slightly less than the distance from the axis of pivot pin 72 to the inside of wall 26 as measured along a line extending radially from the center of the tank through the axis. Therefore, the reach of the assembly 50 is extendable to just within the tank wall 26.

Also located in floor 20 and best shown in FIG. 2, is an outlet opening 88 adjacent to wall 26. An auger trough 90 is positioned below the opening for receiving material from the mixer tank. Auger 92 conveys the material away to a discharge auger (not shown). The augers are driven in a conventional manner from the power takeoff shaft of a tractor. A door (not shown) is slidably positioned across the opening 88 during mixing to prevent material from passing therethrough. Outlet opening 88 and inlet opening 18 are so positioned in bottom 20 that paddle 62 almost completely avoids passing over the openings when in its trailing position shown by the rearmost broken lines in FIG. 2.

In operation, auger 16 conveys ground material such as hay or the like from mill 12 and concentrate from hopper 24 to inlet 18 located adjacent the bottom of auger 40. The materials are forced into the mixing tank 22 through the inlet, and auger 40 rotating in the counterclockwise direction conveys the materials from lower opening 38 of housing 30 up through the housing and out opening 36. Blade assembly 50, rotating with auger 40, passes through the material near the bottom of the tank and aids in the mixing process.

Initially when the tank is empty or nearly empty centrifugal force keeps the cleanout blade 62 in the outward position indicated by the leftmost broken lines in FIG. 2. The arc of rotation 86 of portion 66 of cleanout blade 62 extends beyond the outer end 56 of blade 54 to reach within a fraction of an inch of sidewall 26. As auger 16 conveys more material into the mixing tank and it begins to fill, the loading on blade 62 increases and centrifugal force can no longer overcome the drag caused by the material to keep the blade in the fully extended outward position. Blade 62 pivots gradually as the tank fills from the outward position to a circular arc trailing position as shown by the solid lines. Since blade assembly 50 no longer passes through the concentrated packed mixture around the outside of the tank, torque requirements are greatly reduced. With the cleanout blade 62 in the trailing position, the blade assembly 50 is away from the sidewall 26, approximately the distance between outer end 56 of blade 54 and the wall 26. This increased wall-to-blade spacing also allows roughage material that otherwise would be trapped to slide off the end of blade 54.

The increased distance between the floor 20 and blade 54 eliminates the shear effect encountered previously when the blade was located close to the floor and wall 26. Only a relatively small cross section of blade assembly 50, equal in width to the width of sweep blade edge 66, passes within a fraction of an inch of floor 20 when blade 62 is in the trailing position. In addition, cleanout blade 62 is so mounted on mixing blade 54 that in its trailing position when under load it defines an arc 86 which completely or nearly completely avoids inlet opening 18 or outlet opening 88. Impact loads are thus avoided that might otherwise occur when the blade sweeps over an edge which has coarse material such as hay trapped thereon. Blade 62 is also tapered slightly from the rear edge 66 to the front edge 64 to aid in slicing through the material near the floor 20. Because the blade 62 is free to swing in either direction, it can pivot out of the way of obstructions that would otherwise cause impact loading.

The sweep blade 62 and mixing blade 54 in conjunction with the central auger 40 thoroughly mix the material within tank 22. The sweep blade 62 additionally performs a cutting and chewing function on coarse material that may be introduced into the tank from the mill. Although the blade will pivot away from impact loads as mentioned above, it still gradually chews the materials it contacts to effectively break up any clumps and to cut through coarse materials caught on the edges of the opening.

When the materials have been thoroughly mixed within tank 22, the mixture is discharged through outlet opening 88 located adjacent to the wall 26 and communicating with an auger trough 90. Auger 92 is selectively operable within the trough 90 to transport the material to a discharge auger (not shown).

As the material is unloaded through opening 88, auger 40 with blade assembly 50 continues to rotate to disturb the mixture and increase the flow through the outlet opening. Until the tank is about empty, the material in the tank sufficiently loads the cleanout blade 62 so that it follows in the trailing position shown by the solid lines in FIG. 2. As the tank empties and the loading on the blade decreases, the blade swings by centrifugal force towards the outwardly extended position to sweep the floor 20 close to the wall 26. The blade 62 now passes directly over the outlet opening 88, sweeping the remaining mixture from the corners and bottom of the tank into trough 90 to be removed by the auger 92.

By using the swinging blade or paddle 62, the sweep assembly 50 effectively empties the tank without excessive loading on the assembly while the tank is full. Compared with previous blade assemblies, loading is reduced and mixtures including hay and finer mixtures are more easily and quickly processed. Since shear effects are reduced, the end of the assembly does not have to be confined under a guide to maintain uniform floor-to-blade clearance. The sweep or extension member 58 is self-supporting and swingable about the vertical axis on blade 54 so that it sweeps close to but does not touch the floor. A blade-to-floor distance of 0.2 inch has been found to provide good sweeping action.

The distance from the outer end 56 of blade 54 to the wall 26 is chosen so that the blade does not have to pass through material packed toward the outside of the tank and so coarse material can slide off the end. The preferred distance is several inches, preferably about 6 inches, and can vary somewhat depending on the type of material and the amount of loading that can be tolerated. For materials that have less tendency to pack, the distance can be decreased.

I claim:

1. For a mixer tank with a floor, an upright cylindrically shaped sidewall, and a central shaft carried for rotation within said tank on the axis thereof, a mixer blade assembly comprising:

a radially extending arm member including an inner radial portion for supporting said member with respect to the shaft for rotation therewith in a substantially horizontal plane; and an extension member freely mounted about a vertical pivot on the arm member and including a portion supporting it on the vertical pivot so that it swings in a substantially horizontal plane and is retained thereby in close but vertically offset relation to the floor.

2. The invention defined in claim 1 wherein said arm member includes a radially outward end spaced inwardly from the sidewall and said extension member includes an end portion defining an arc of rotation as said member swings, a portion of said arc extending between the sidewall and the outward end.

3. The invention defined in claim 1 wherein said arm member and extension members are flat and substantially parallel to each other and the floor.

4. In a material mixer tank having a floor, an upright cylindrical shaped tank wall, and a central shaft carried within said tank on the axis thereof, a sweep assembly rotatably driven by said shaft comprising:

an arm member coupled with the shaft adjacent to but spaced above the floor, said arm member extending radially outwardly from the shaft and terminating adjacent to and inwardly from the tank wall; and extension means freely pivotally mounted about a vertical pivot on the arm member, said extension means having an effective length substantially equal to the distance from said pivot to the tank wall.

5. The invention defined in claim 4 wherein the extension means comprises a blade member having a portion connected to the pivot and disposed between the arm member and the floor.

6. The invention defined in claim 5 wherein the blade member has its center of gravity located radially outwardly from the pivot.

7. The invention defined in claim 5 wherein the blade member is flat and essentially parallel to the floor.

8. The invention defined in claim 5 wherein the blade member is spaced from the floor approximately 0.2 inch.

9. The invention defined in claim 8 wherein the arm member is spaced above the floor approximately 1.2 inches.

10. The invention defined in claim 9 wherein the arm member terminates approximately 6 inches inwardly from the inside wall.

11. In a mixer having a floor, a cylindrically shaped sidewall rising vertically from the floor, a shaft mounted for rotation about a centrally located vertical axis, and a mixing blade operably connected to and radially extending from the shaft, said blade spaced above the floor and including a blade end adjacent to and spaced from the wall, mixing blade extension means comprising:

a paddle member pivotally connected to the mixing blade adjacent the blade end for free swinging movement about a vertical pivotal axis and including a sweep member located between said blade and the floor, said sweep member having an end portion extending radially from said pivotal axis a distance substantially equal to the distance between said axis and the tank wall.

12. In a mixing device having a cylindrically shaped tank extending upwardly from a floor, and a rotatable shaft positioned substantially centrally within said tank, an improved mixing blade assembly comprising:

first blade means rotatably coupled with the shaft and extending radially therefrom, said blade means spaced above the floor and including an end portion adjacent to and spaced from the wall; and second blade means pivotally connected to the first blade means for pivoting about a vertical axis, said second blade means spaced between the first blade means and the floor and having a free end portion swingable in an arc of pivotal rotation a portion of which extends in the area between the end portion of the blade means and the inside wall.

13. In a mixing apparatus having a vertical cylindrically shaped mixing tank wall with a substantially flat bottom, and an internal mixing auger concentric with said tank, a blade assembly comprising:

a first member connected for rotation with the auger about its axis, said first member including a radially extending portion terminating at a radial outer end portion adjacent to and spaced from the tank wall, said first member being spaced above the bottom; and a centrifugal member proximate the end portion freely swingably carried by and beneath the first member for swinging radially outwardly about a pivotal axis substantially parallel to the auger axis.

14. The invention defined in claim 13 wherein the centrifugal member includes a remote free end movable in an arc of pivotal rotation, a portion of which is radially outwardly of the end portion of said first member.

15. The invention defined in claim 13 wherein the centrifugal member includes a center of gravity located between the pivotal axis and the free end whereby said member may swing outwardly by centrifugal force as the blade assembly rotates.

* * * * *